US011959301B2

(12) United States Patent
Ramos

(10) Patent No.: US 11,959,301 B2
(45) Date of Patent: Apr. 16, 2024

(54) PORTABLE INFLATABLE POOL SYSTEMS AND METHODS

(71) Applicant: Belgravia Wood Limited, Tortola (VG)

(72) Inventor: Jaime Ramos, Moorpark, CA (US)

(73) Assignee: Belgravia Wood Limited, Tortola (VG)

( * ) Notice: Subject to any disclaimer, the term of this patent is extended or adjusted under 35 U.S.C. 154(b) by 253 days.

(21) Appl. No.: 17/309,194

(22) PCT Filed: Jul. 23, 2020

(86) PCT No.: PCT/US2020/043206
§ 371 (c)(1),
(2) Date: May 5, 2021

(87) PCT Pub. No.: WO2021/016424
PCT Pub. Date: Jan. 28, 2021

(65) Prior Publication Data

US 2022/0034112 A1 Feb. 3, 2022

Related U.S. Application Data

(60) Provisional application No. 62/877,403, filed on Jul. 23, 2019.

(51) Int. Cl.
*E04H 4/00* (2006.01)
*E04H 4/14* (2006.01)

(52) U.S. Cl.
CPC ..... *E04H 4/0025* (2013.01); *E04H 4/14* (2013.01)

(58) Field of Classification Search
CPC ..... E04H 4/0025; E04H 4/14; A47K 3/06
USPC ..... 4/506, 513, 585, 588
See application file for complete search history.

(56) References Cited

U.S. PATENT DOCUMENTS

| | | | | |
|---|---|---|---|---|
| 2,689,812 A | | 9/1954 | Mollica et al. | |
| 2,838,768 A | | 6/1958 | Fischett | |
| 3,363,268 A | | 1/1968 | Friedlander | |
| 3,681,789 A | * | 8/1972 | Bott | A47K 3/06 4/588 |

(Continued)

FOREIGN PATENT DOCUMENTS

| | | | |
|---|---|---|---|
| DE | 8804198 U1 | | 6/1988 |
| JP | H11124195 A | * | 5/1999 |

OTHER PUBLICATIONS

Int.ernational Search Report dated Nov. 19, 2020, of PCT/US2020/043206 (35 pages).

*Primary Examiner* — Tuan N Nguyen
(74) *Attorney, Agent, or Firm* — Finnegan, Henderson, Farabow, Garrett & Dunner LLP

(57) ABSTRACT

Disclosed herein is a fluid container comprising: a base, having a bottom portion and a side portion, the bottom portion and the side portion being one unitary sheet, and a side wall joined to the base at the side portion and defining an interior volume of the fluid container, the side wall comprising: a first plastic material, an inner wall, an outer wall, at least one inflatable air chamber defined by a volume between the inner wall and the outer wall and substantially continuous throughout the side wall, and at least one air valve disposed on the outer wall and in fluid communication with the at least one inflatable air chamber. Also disclosed herein are methods of making and using the same.

19 Claims, 14 Drawing Sheets

(56) References Cited

U.S. PATENT DOCUMENTS

| | | | | |
|---|---|---|---|---|
| 4,068,326 | A * | 1/1978 | Deschler | A47K 3/06 4/588 |
| 5,570,480 | A | 11/1996 | Yeung | |
| 2004/0040083 | A1* | 3/2004 | Bentley | A47K 3/06 4/585 |
| 2006/0266272 | A1 | 11/2006 | Bernath | |
| 2009/0178191 | A1 | 7/2009 | MacLean | |
| 2010/0235988 | A1* | 9/2010 | Pittman | A47C 21/048 5/119 |
| 2011/0094025 | A1* | 4/2011 | West | E04H 4/0025 4/506 |
| 2016/0362904 | A1* | 12/2016 | Liu | E04H 4/0025 |

* cited by examiner

PORTABLE INFLATABLE POOL SYSTEMS AND METHODS

CROSS REFERENCES TO RELATED APPLICATIONS

This application is the National Phase of PCT International Application No. PCT/US2020/043206, filed on Jul. 23, 2020, which claims priority under 35 U.S.C. § 119(e) to U.S. Provisional Application No. 62/877,403, filed on Jul. 23, 2019. The entire contents of the above-referenced applications are incorporated herein by reference.

FIELD OF THE DISCLOSURE

The present disclosure relates generally to portable inflatable pools. Particularly, examples of the present disclosure relate to portable inflatable pool systems and methods.

BACKGROUND

A variety of portable above-ground swimming pools are known. Some are inflatable and have hollow inflatable side walls capable of containing water, whereas others are known as frame pools. Common types of inflatable pools can have flexible and buoyant side walls to withstand the hydrostatic forces of the water while providing a level of structural integrity and rigidity to the pool. Such pools can be manufactured in a variety of shapes and sizes, thereby allowing a consumer to choose a pool that suits their particular needs.

Common above-ground pools offer far more flexibility and modularity than complex in-ground pools. Above-ground pools may be temporary, lightweight, and moveable. Due to the large forces at work in combating the hydrostatic pressure in a pool, an above-ground pool must have the ability to retain its structure when in use. In some cases, external structures or support elements are needed to support the pool and assist in defining the volume of the pool, such as a frame. However, a user of the pool may desire the pool to be more portable without necessitating a large and heavy frame to setup before using the pool. If a user of the pool already had a predefined area or volume in mind for where to place or use a pool however, the user could simply place the pool in the predefined area without the need for a frame or other structural elements. Thus, a user of the portable pool could set up their pool whenever and wherever they could find such a predefined area or volume.

What is needed, therefore, is a portable inflatable above-ground pool that can retain its structure when in use and are placed in a predefined area or volume. Examples of the present disclosure address this need as well as other needs that will become apparent upon reading the description below in conjunction with the drawings.

BRIEF SUMMARY

The present disclosure relates to portable inflatable pool systems and methods. An exemplary example of the present disclosure can provide a fluid container, comprising: a base, having a bottom portion and a side portion; and a side wall joined to the base at the side portion and defining an interior volume of the fluid container, the side wall comprising a first plastic material; an inner wall; an outer wall; at least one inflatable air chamber defined by a volume between the inner wall and the outer wall, and at least one air valve disposed on the outer wall and in fluid communication with the at least one inflatable air chamber.

In any of the examples disclosed herein, the at least one inflatable air chamber can comprise a first inflatable air chamber joined to the base at the side portion, and a second inflatable air chamber joined to the first inflatable air chamber.

In any of the examples disclosed herein, the first and the second inflatable air chambers may be aligned in the side wall substantially vertically.

In any of the examples disclosed herein, the at least one inflatable air chamber can be substantially continuous around the side wall.

In any of the examples disclosed herein, the at least one air valve can comprise a first air valve disposed on the outer wall and in fluid communication with the first inflatable air chamber, and a second air valve disposed on the outer wall and in fluid communication with the second inflatable air chamber.

In any of the examples disclosed herein, the first plastic material may be a flexible plastic material.

Another example of the present disclosure can provide a pool having a predefined volume capacity, the pool comprising: a base, having a bottom portion and a side portion, and a side wall joined to the base at the side portion and defining an interior volume of the fluid container, the side wall comprising, a first plastic material; an inner wall, an outer wall; and at least one upward force providing member configured to retain the side wall in an erect position.

In any of the examples disclosed herein, the at least one upward force providing member may comprise an inflatable air chamber defined by a volume between the inner wall and the outer wall.

Also disclosed herein are methods of making and using the same.

These and other aspects of the present disclosure are described in the Detailed Description below and the accompanying figures. Other aspects and features of examples of the present disclosure will become apparent to those of ordinary skill in the art upon reviewing the following description of specific, exemplary examples of the present disclosure in concert with the figures. While features of the present disclosure may be discussed relative to certain examples and figures, all examples of the present disclosure can include one or more of the features discussed herein. Further, while one or more examples may be discussed as having certain advantageous features, one or more of such features may also be used with the various examples of the disclosure discussed herein. In similar fashion, while exemplary examples may be discussed below as device, system, or method examples, it is to be understood that such exemplary examples can be implemented in various devices, systems, and methods of the present disclosure.

BRIEF DESCRIPTION OF THE DRAWINGS

The accompanying drawings, which are incorporated in and constitute a part of this specification, illustrate multiple examples of the presently disclosed subject matter and serve to explain the principles of the presently disclosed subject matter. The drawings are not intended to limit the scope of the presently disclosed subject matter in any manner.

DETAILED DESCRIPTION

Figure 1:
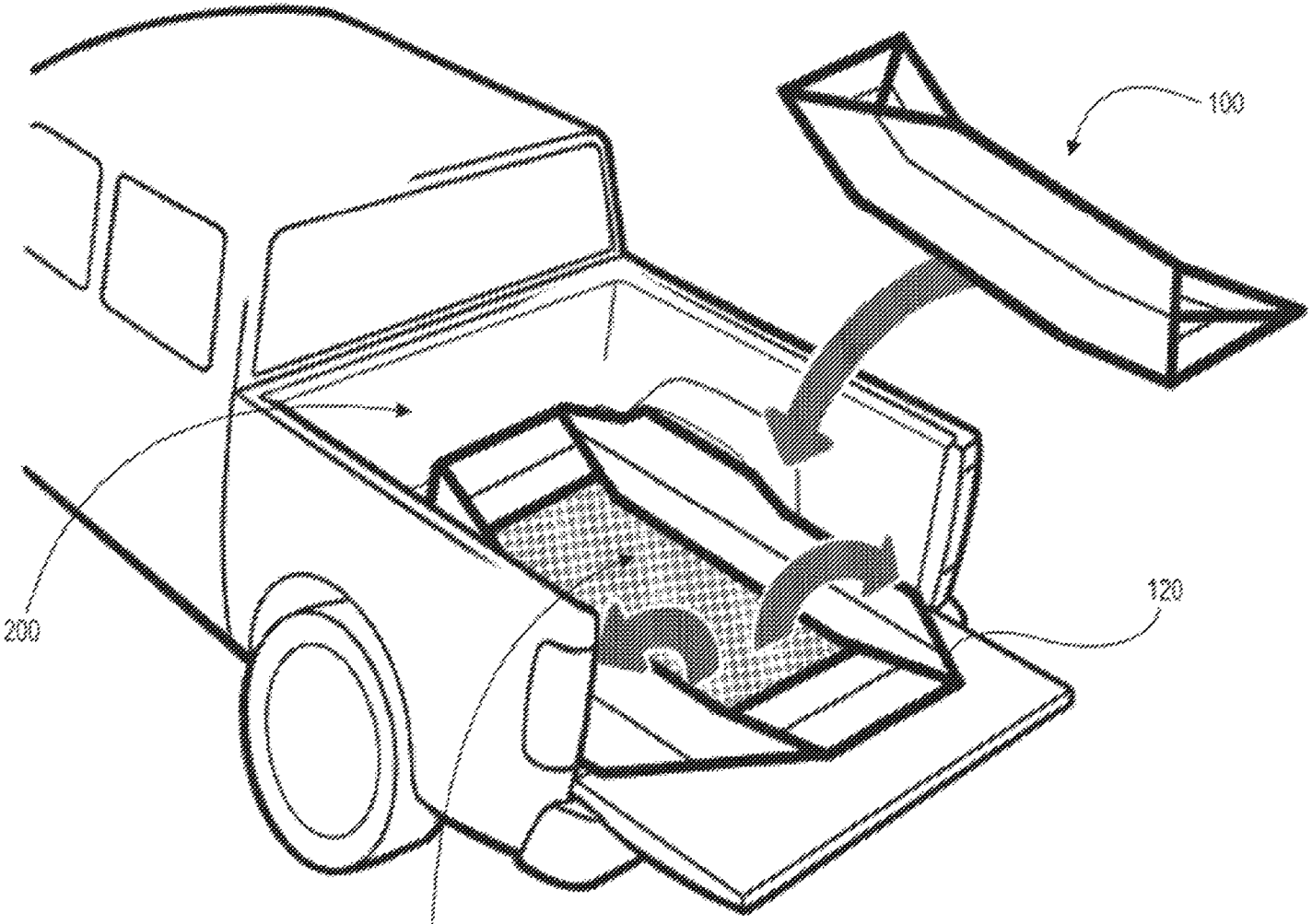
FIG. 1 is a perspective view a folded pool inside a predetermined volume according to some examples of the present disclosure.

Although certain examples of the disclosure are explained in detail, it is to be understood that other examples are contemplated. Accordingly, it is not intended that the disclosure is limited in its scope to the details of construction and arrangement of components set forth in the following description or illustrated in the drawings. Other examples of the disclosure are capable of being practiced or carried out in various ways. Also, in describing the examples, specific terminology will be resorted to for the sake of clarity. It is intended that each term contemplates its broadest meaning as understood by those skilled in the art and includes all technical equivalents which operate in a similar manner to accomplish a similar purpose.

Herein, the use of terms such as "having," "has," "including," or "includes" are open-ended and are intended to have the same meaning as terms such as "comprising" or "comprises" and not preclude the presence of other structure, material, or acts. Similarly, though the use of terms such as "can" or "may" are intended to be open-ended and to reflect that structure, material, or acts are not necessary, the failure to use such terms is net intended to reflect that structure, material, or acts are essential. To the extent that structure, material or acts are presently considered to be essential, they are identified as such.

By "comprising" or "containing" or "including" is meant that at least the named compound, element, particle, or method step is present in the composition or article or method, but does not exclude the presence of other compounds, materials, particles, method steps, even if the other such compounds, material, particles, method steps have the same function as what is named.

It is also to be understood that the mention of one or more method steps does not preclude the presence of additional method steps or intervening method steps between those steps expressly identified.

The components described hereinafter as making up various elements of the disclosure are intended to be illustrative and not restrictive. Many suitable components that would perform the same or similar functions as the components described herein are intended to be embraced within the scope of the disclosure. Such other components not described herein can include, but are not limited to, for example, similar components that are developed after development of the presently disclosed subject matter.

As described above, the large forces at work in combating the hydrostatic pressure in a pool require an above-ground pool to have the ability to retain its structure when in use. In some cases, external structures or support elements are needed to support the pool and assist in defining the volume of the pool, such as a frame. But a user of the pool may desire the pool to be more portable without necessitating a large and heavy frame to setup before using the pool. If a user of the pool already had a predefined area or volume in mind for where to place or use a pool however, the user could simply place the pool inside the predefined area without the need for a frame or other structural elements. Thus, a user of the portable pool could set up their pool whenever and wherever they could find such a predefined area or volume.

Examples of the present disclosure can provide a pool for use in a predefined volume, the pool comprising a base, a side wall, and at least one inflatable air chamber. In some examples, the base can comprise a bottom portion and a side portion. In some examples, the bottom portion and the side portion can be made from a plastic material, such as a flexible plastic material or a hard-plastic material, and may be made from single (i.e., unitary) sheet. Suitable examples of a hard or flexible plastic material can include, but are not limited to, polyethylene (PE), polypropylene (PP), polyethylene terephthalate (PET), polystyrene, polystyrene butadiene, polybutylene succinate (PBS), polyester, polycarbonate, polyvinyl chloride (PVC), polymethyl methacrylate, acrylonitrile butadiene styrene, chlorinated polyvinyl chloride, nylon, polylactic acid, polytetrafluoroethylene, or a combination thereof. In other words, the bottom portion and the side portion of the base may be different portions of the same sheet where no form of attachment is needed between the bottom portion and the side portion. In some cases, the side portion may form a raised lip section around the bottom portion. In other examples, the side portion may be a separate sheet and may be joined to the bottom portion using techniques known to those of ordinary skill in the art, such as stitching, adhesives, radio frequency welding, welding, combinations thereof, and the like.

In some examples, the side wall can attach to the base at the side portion. For example, one of ordinary skill would understand that the side wall can be attached to the base using techniques such as stitching, adhesives, radio frequency welding, welding, combinations thereof, and the like. One of skill in the art would appreciate that a side wall comprising a material similar to that of the base would provide easier joining of the side wall to the base. As such, the side wall can be made from a plastic material, such as a flexible plastic material or a hard-plastic material, as described above. The side wall may define the interior volume of the pool and can provide the structure of the pool to take on any shape desired. For example, the side wall can provide a pool in a shape that is substantially a circle, square, rectangle, rectangle with rounded corners, triangle, triangle with rounded corners, oval, ellipse, and the like. In some examples, the side wall can be formed in shapes to fit the theme of the pool. For example, in a nautically themed pool, the side wall can take the shape of fish, shells, crabs, starfish, boats, waves, a lighthouse, and the like. For the sake of safety, if the side wall forms a shape with sharp edges or corners, the sharp edges or corners can be rounded such that there is no risk of injury to a user of the pool. In some examples, the pool may have multiple side walls or side wall sections that form the side wall as disclosed herein.

The base and the side wall may be formed of the same material or different materials, and in examples involving more than one side wall, each side wall may be formed of the same or different materials. For example, in some examples, the base and the side wall of the pool may be formed from a natural textile (e.g., burlap, jute, etc.) or synthetic material (e.g., plastic, polyurethane, PVC, nylon, etc.). In some examples, the base may be formed from a natural textile and the side wall may be formed of a synthetic material. Many materials (including water-permeable textiles, etc.) may be used to construct a pool; the materials, however, should be treated to retain water. For example, such materials could be adhered to, laminated with, coated with, or bonded to a material impermeable to water. The base may be formed from a nylon shell, which may be laminated or otherwise treated to hold water. For example, the nylon shell might be bonded to another material, such as a poly urethane, PVC, vinyl, or other suitable impermeable lining to provide the desirable waterproof qualities, and to provide a more pleasing tactile quality to the interior of the pool. Similarly, the side wall of the pool may be constructed from these materials, or other materials having similar suitable qualities. The materials that are used may be selected for their durability.

A large portion of the side wall may be transparent in nature. Such a portion could comprise a porthole (i.e., a window) or could be larger than a porthole, comprising, for example, a portion or all of the side wall itself. For example, half of the side wall may be transparent in nature, or the entire side wall may be transparent. As will be appreciated, the side wall having a substantial transparent portion is more desirable to consumers as they enable a significantly larger viewing area.

A drainage assembly can be integrated into the pool. In some examples, the drainage assembly is a cork or similar device that is removeable from the pool such that, when removed, the water from the pool may be drained. The drainage assembly also may be a valve enabling control of draining the pool. One skilled in the art would appreciate that the drainage assembly may be many devices enabling easy draining of the pool, safely and environmentally. The drain assembly may also comprise a hard or soft plastic material, or combination thereof, and can be disposed substantially within a drain aperture in the side wall.

The drain assembly can be located in various locations on the pool as appropriate. For example, the drain assembly can be disposed on the side wall of the pool and can substantially surround a drain hole aperture formed in the side wall. The drain assembly also can be disposed on the base of the pool as appropriate. The drain assembly also can be disposed on the side portion of the base. In some examples, the drain assembly can be disposed on an area substantially between the side wall and the base.

In some examples, the side wall may comprise an inner wall and an outer wall. The inner wall may be sealable to the outer wall by techniques such as stitching, adhesives, radio frequency welding, welding, combinations thereof, and the like. The inner wall and the outer wall may be different sides of one single (i.e., unitary) sheet, or the inner wall and the outer wall may be two separate sheets. If they are two separate sheets, the inner wall and the outer wall may be interconnected, intertwined, reinforced, or otherwise in communication with one another. In some examples, there may be a void between the inner wall and the outer wall. This void may define an inflatable air chamber. The side wall may comprise at least one inflatable air chamber defined by the inner wall and the outer wall (i.e., one or more, two or more, three or more, four or more, five or more, six or more, or seven or more). In some examples, the inflatable air chamber may be continuous around the side wall. In other examples, the inflatable air chambers may be separately contained from one another. For example, the void between the inner wall and the outer wall may comprise partitions connecting the inner wall and the outer wall to create multiple inflatable air chambers. In some examples, the inflatable air chambers may be separate chambers joined together to form the side wall. The inflatable air chambers additionally may be aligned horizontally (i.e., in series) or vertically (i.e., in parallel). For example, the side wall may comprise air chambers joined together and stacked substantially vertically in the side wall.

In some examples, the side wall may further comprise an air valve in fluid communication with the inflatable air chamber. Each inflatable air chamber may be in fluid communication with its own air valve. The air valve may be disposed on the outer wall or the inner wall and provide a means of inflating the inflatable air chamber to which it is in communication. For example, if the side wall comprises two inflatable air chambers aligned vertically, the side wall may further comprise two air valves disposed on the outer wall in fluid communication with the two inflatable air chambers. In such an example, the two air valves may or may not be aligned with each other. In some examples, the side wall can comprise separate air valves for inflation and deflation. In other words, the air valves may be one-way valves. In some examples, the air valves may be two-way valves capable of both inflation and deflation. The air valves may be made of any hard or flexible plastic material and may be welded to the side wall using one or more welds. Other means of attaching the air valves to the side wall are contemplated, such as sewing and adhesives.

In some examples, the pool may be foldable or collapsible. When not in use, the pool may fold or collapse to provide easier storage and mobility. For example, a user of the pool may deflate the inflatable air chambers to collapse the pool and then fold the pool for storage. Accordingly, the pool may be unfolded prior to use and inflation. The smaller dimensions of the pool in a folded state make it easier for a user to transport the pool and move the pool, thus making the pool portable.

In some examples, the pool may not have a drain. A user of the pool may be able to drain the pool simply by deflating the inflatable air chambers to collapse the side wall. For instance, a user may simply open the air valves on the side wall to release the air and collapse the side wall. In such an example, the water may drain over the collapsed side wall. Such an example can provide for rapid and user-friendly drainage of the pool. Additionally, the force of the water flowing over the collapsed side wall may aid in deflating the one or more inflatable air chambers.

Examples of the present disclosure can provide a predetermined volume for use with pools of the present disclosure. A predetermined volume may eliminate the need for additional support elements to form the pool. The predetermined volume may provide a support and shape for the pool, and the pool may be configured to conform to the shape of any predetermined volume. For example, a pickup truck cargo bed can be provided in a substantially rectangular shape A pool of the present disclosure may be inserted into the pickup truck cargo bed and may take the shape of the pickup truck cargo bed. In such an example, the predetermined volume of the cargo bed may define the interior volume of the pool, and the walls of the cargo bed may provide support to the pool side wall. It is understood that other predetermined volumes may be used, such as gazebos, recesses, rooms, and the like. Any predetermined volume may be selected to fit the pool such that the predetermined volume can define the interior volume of the pool and the walls or edges of the predetermined volume can provide support to the pool side wall.

Also disclosed herein are methods of forming a pool in a predetermined volume, the method comprising providing a predetermined volume, placing a pool along a base of the predetermined volume, inflating the pool, stretching the base of the pool to fill the predetermined volume, and filling the pool with water. In some examples, the method may further comprise unfolding the pool in the predetermined volume.

Reference will now be made in detail to exemplary examples of the disclosed technology, examples of which are illustrated in the accompanying drawings and disclosed herein. Wherever convenient, the same references numbers will be used throughout the drawings to refer to the same or like parts.

As shown in FIG. 1, pool 100 can comprise base 110 and side wall 120. In some examples, pool 100 can be portable and foldable, as shown. If desired, a user of pool 100 can place pool 100 in predetermined volume 200 to provide structural support and definition to pool 100. A user of pool 100 may place the pool in predetermined volume 200 in a folded state and may expand pool 100 to meet the confines of predetermined volume 200. The predetermined volume 200 can be, for example, a pickup truck bed. The predetermined volume 200 can also any enclosed or semi-enclosed space, such as garden sheds, wagons, trailers, and the like.

Figure 2:
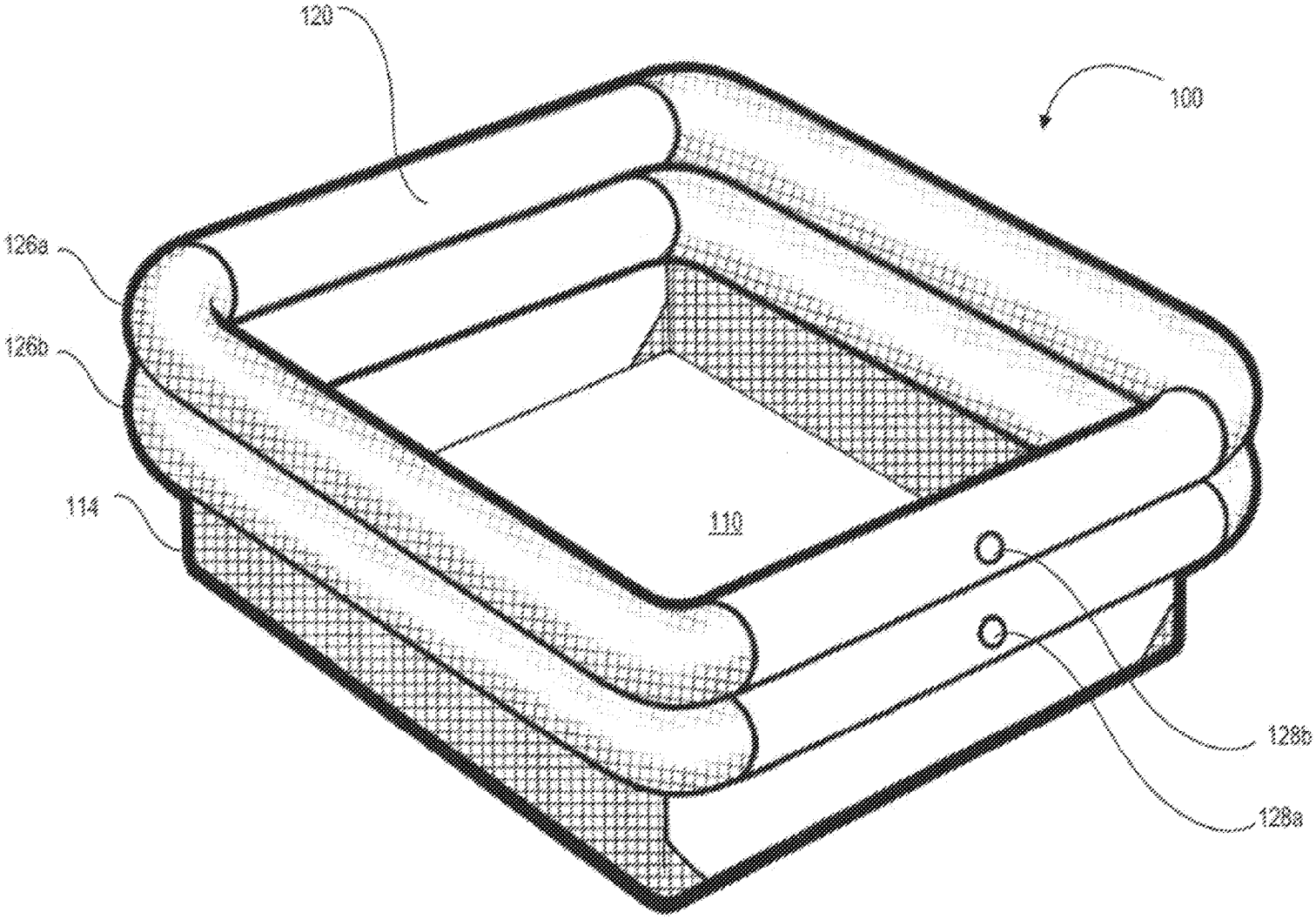
FIG. 2 is a perspective view of the inflation of a pool in a predetermined volume according to some examples of the present disclosure.

As shown in FIG. 2, upon expanding pool 100 to meet the confines of predetermined volume 200, pool 100 may be transitioned from a folded state to a deployed state. A user of pool 100 may extend pool 100 such that base 110 is contacted with a base of predetermined volume 200. In some examples, the transition from a folded state to a deployed state can comprise inflating some or all of pool 100. For example, side wall 120 may be inflated. It is understood that other means capable of transitioning pool 100 from a folded state to a deployed state are contemplated, such as stretching or reinforcing with support elements. In some examples, to aid in the aforementioned transition, side wall 120 may comprise one or more inflatable air chambers, such as first inflatable air chamber 126*a* and second inflatable air chamber 126*b*. Each of the inflatable air chambers 126*a* and 126*b* may have respective one or more air valves 128*a* and 128*b*. One or more air valves 128*a* and 128*b* may be disposed on side wall 120 and in fluid communication with inflatable air chambers 126*a* and 126*b* such that air or other such gases may pass through side wall 120 into inflatable air chambers 126*a* and 126*b*. It is to be understood that any number of inflatable air chambers and air valves are contemplated and would be capable of transitioning pool 100 from a folded state to a deployed state. For example, FIG. 2 illustrates two inflatable air chambers (126*a* and 126*b*) with two respective air valves (128*a* and 128*b*). But the pools of the present disclosure may comprise any number of inflatable air chambers or air valves as described above.

Figure 3A:
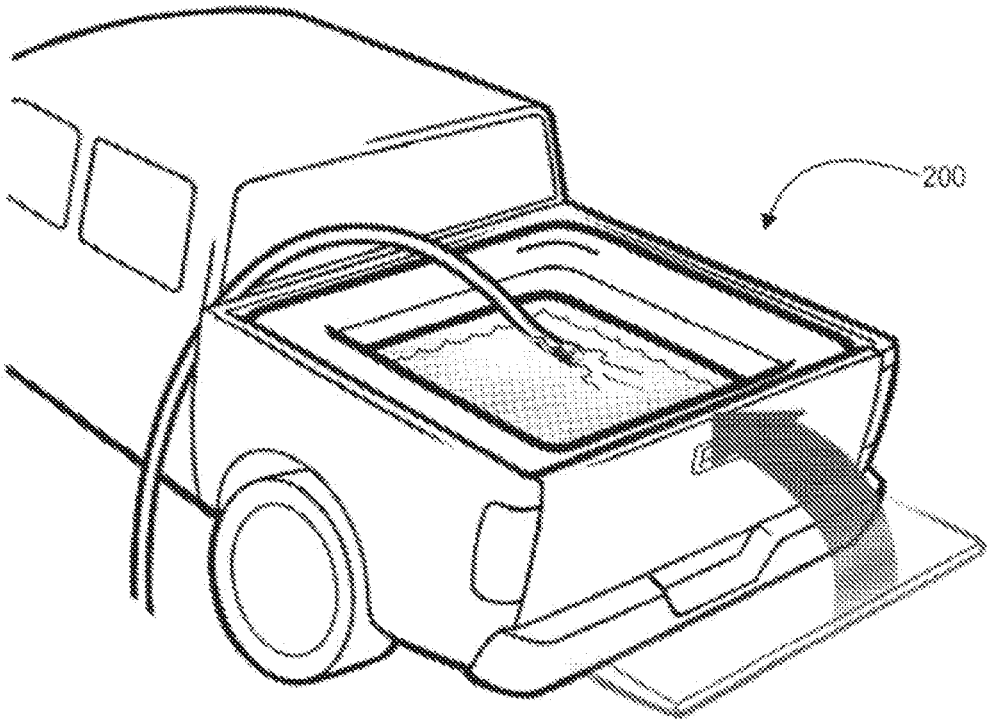
FIG. 3A is a perspective view of the filling of a pool with water in a predetermined volume according to some examples of the present disclosure.
Figure 3B:
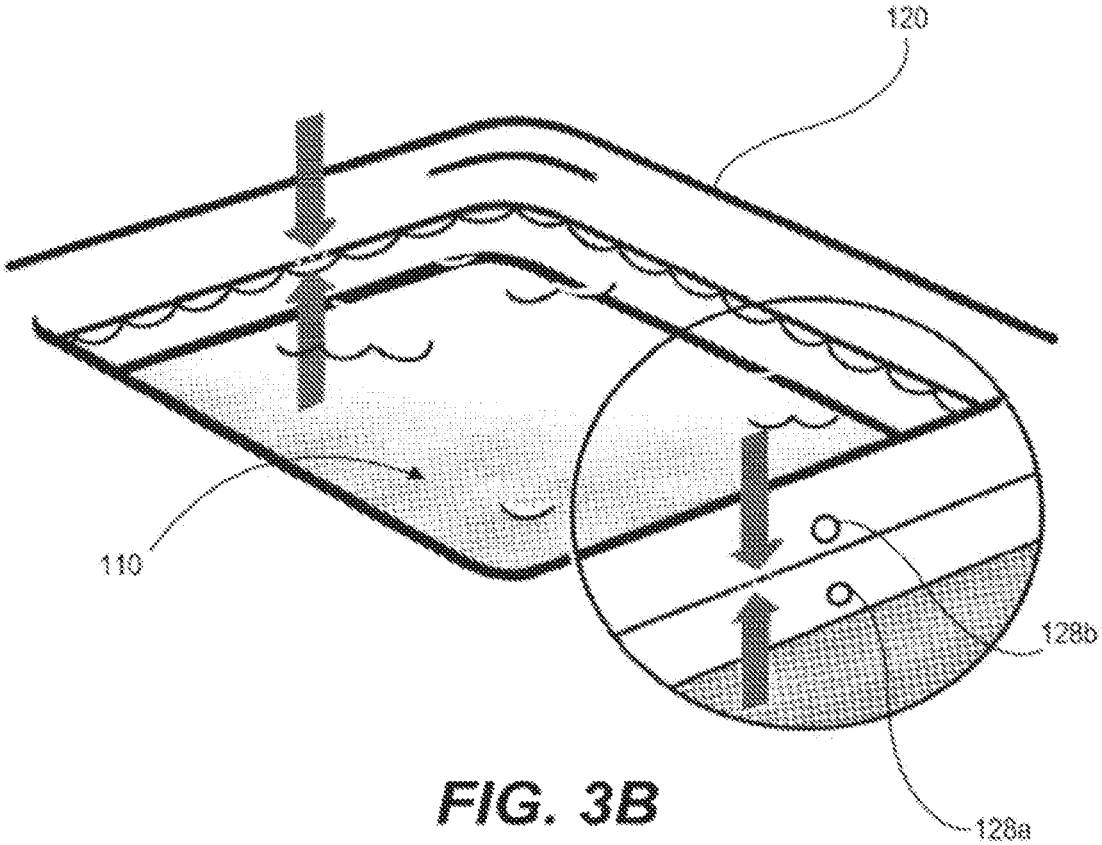
FIG. 3B is a perspective view of a filled pool in a predetermined volume according to some examples of the present disclosure.

As shown in FIGS. 3A and 3B, once pool 100 is transitioned into the deployed state, pool 100 can be filled with water. The rising water level can provide a buoyant force to the one or more inflatable air chambers to drive the inflatable air chambers upwards. Driving the inflatable air chambers upwards using buoyant force may further erect pool 100 by providing an upward force to side wall 120. As such, filling pool 100 with water may further aid in transitioning pool 100 from a folded state to a deployed state and may further expand pool 100 to meet the confines of predetermined volume 200. Further, as shown in FIG. 3B, the one or more air valves (illustrated by air valves 128*a* and 128*b*) may be settled or closed once the inflatable air chambers are inflated to prevent loss of air pressure during use. The same air valves may be opened after use to deflate live inflatable air chambers, or the side wall may comprise additional deflation air valves for deflating.

Figure 4:
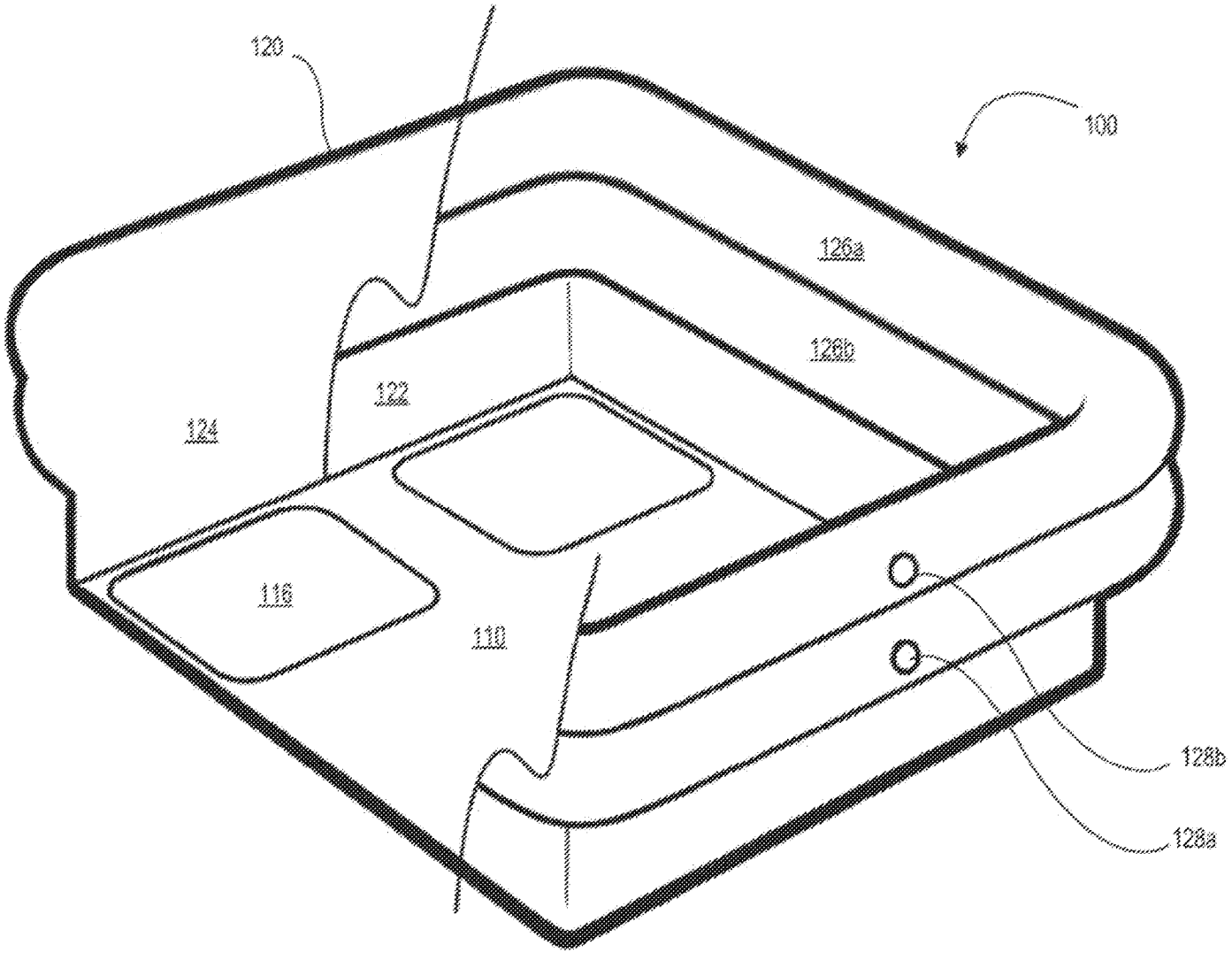
FIG. 4 is a perspective view of another pool in a predetermined volume according to some examples of the present disclosure.

As shown in FIG. 4, pool 100 can be expanded in the deployed state to meet the confines of predetermined volume 200. Additionally, side wall 120 can comprise inner wall 122 and outer wall 124. In some examples, the one or more inflatable air chambers can be defined by an interior volume between inner wall 122 and outer wall 124. Additionally, when side wall 120 further comprises one or more air valves, the one or more air valves (128*a* and 128*b*) can be disposed on outer wall 124 to improve ease of access. Air valves 128*a* and 128*b* can provide fluid communication between outer wall 124 and the one or more inflatable air chambers defined by the interior volume between inner wall 122 and outer wall 124.

Additionally, the base 110 can include padded seats 116. The padded seats 116 can be integrated onto the base 110. The padded seats 116 can smooth out the edges on the predetermined volume 200, such as a truck bed floor. The padded seats 116 can eliminate the need for the pool 100 to be deployed on a soft and/or forgiving environment, such as on springy grass or smooth cement. The padded seats 116 can be inflatable, having one or more inflatable air chambers. Alternatively, or additionally, the padded seats 116 can be made from foam (or other compressible material) that adjusts to the surface of the predetermined volume 200 to create an even and soft area to sit on. The padded seats 116 can be attached to live base 110 of the pool 100 through adhesives, fasteners, RF welding, and the like.

Figure 5A:
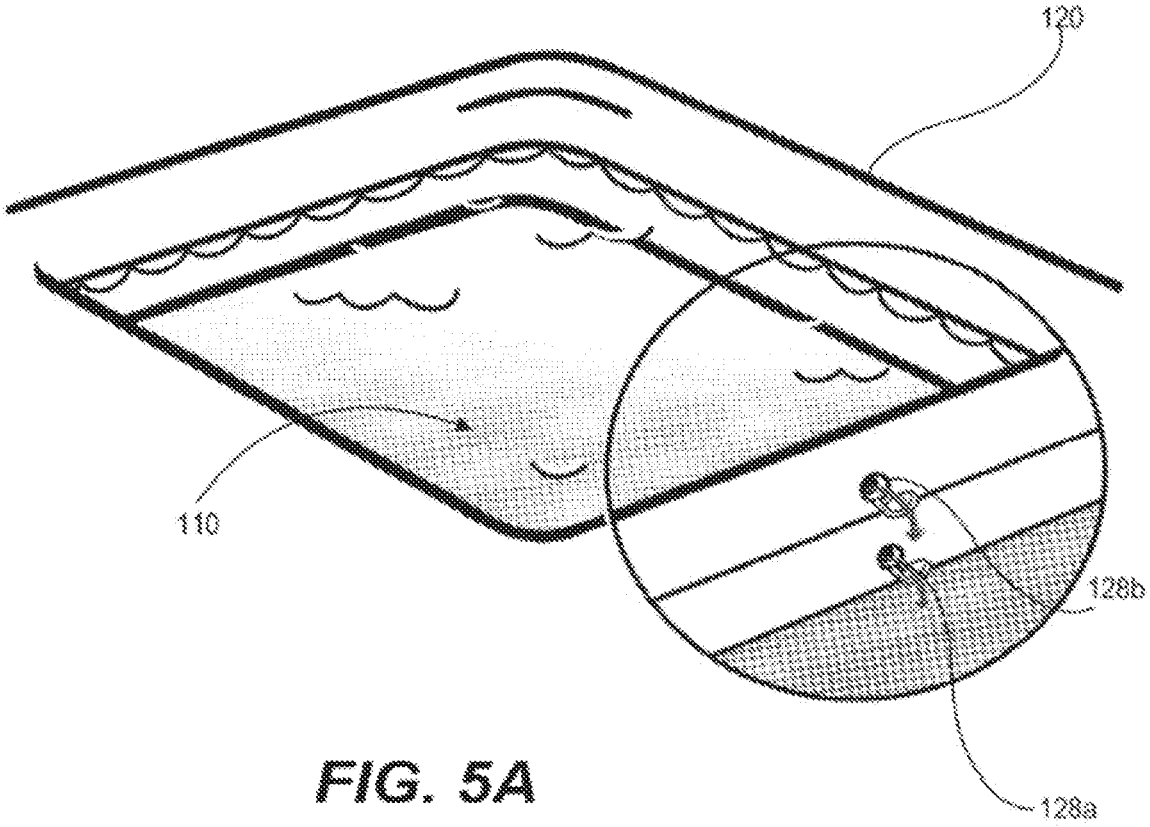
FIG. 5A is a perspective view of a pool with one or more air valves according to some examples of the present disclosure.
Figure 5B:
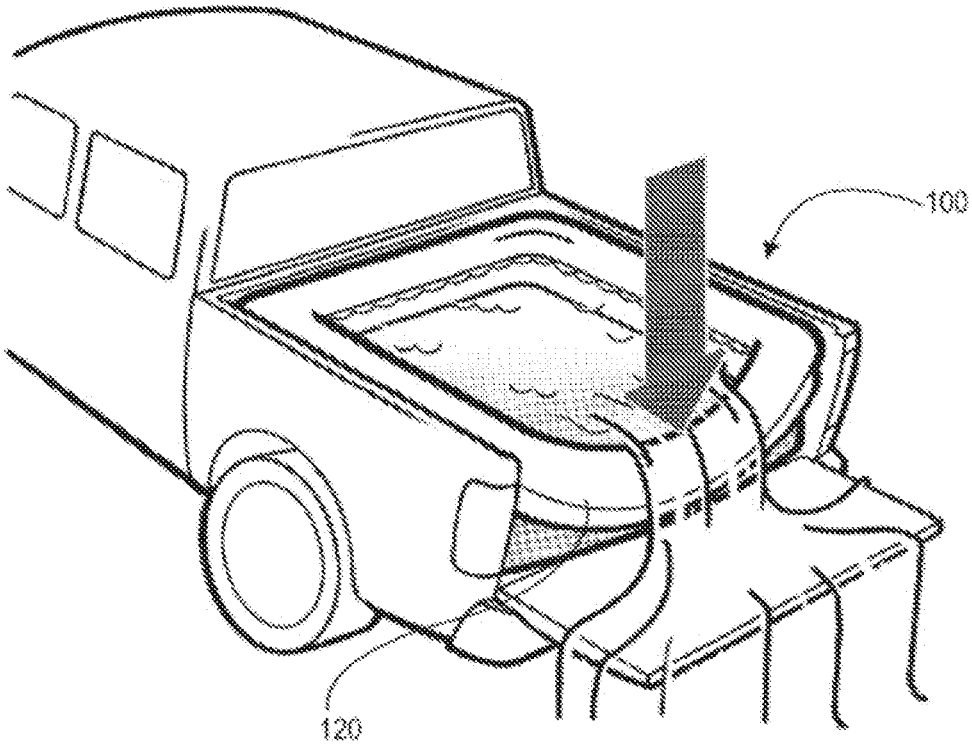
FIG. 5B is a perspective view of the draining of a pool in a predetermined volume according to some examples of the present disclosure.

As shown in FIGS. 5A and 5B, pool 100 can be further transitioned from a deployed state to a folded state by draining the air and water from pool 100 after use. As shown in FIG. 5A, air valves 128*a* and 128*b* may be opened to allow air to flow out of the one or more inflatable air chambers and thus out of side wall 120. In some examples, the air valves 128*a* and 128*b* used to release air from the one or more inflatable air chambers may be separate air valves from the air valves used to inflate the one or more inflatable air chambers. In some examples, air valves 128*a* and 128*b* may be two-way valves capable of inflating or deflating the one or more inflatable an chambers. Pool 100 can comprise a drain to allow water to flow out of pool 100, or, as shown in FIG. 5B, the deflation and collapse of side wall 120 may allow water to flow out of pool 100. Such an example can provide quick and easy draining of pool 100 for a user to easily return pool 100 to a folded state from a deployed state.

Figure 6:
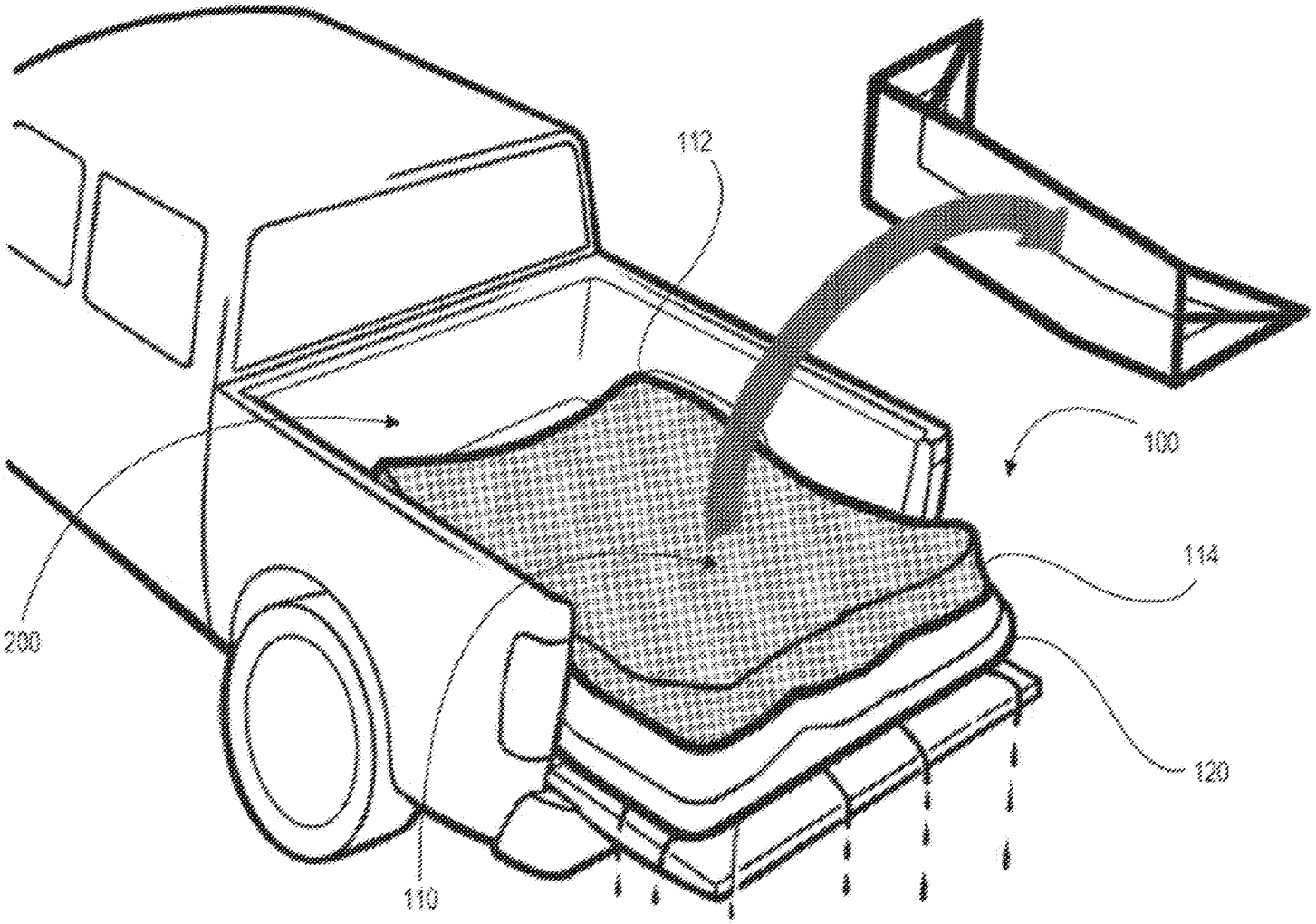
FIG. 6 is a perspective view of the draining and folding of a pool in a predetermined volume according to some examples of the present disclosure.

FIG. 6 illustrates a bottom view of pool 100. In some examples, pool 100 may be flipped upside down to fully drain ail water from pool 100 before returning to a folded state. After pool 100 is fully drained of water and the one or more inflatable air chambers are substantially deflated, a user of pool 100 may fold pool 100 as shown. Folding pool 100 creates a portable and easy-to-use pool within a predetermined volume 200.

As shown, pool 100 can comprise base 110 and side wall 120 and can be placed within predetermined volume 200. Base 110 can comprise bottom portion 112 and side portion 114. In some examples, base 110 may be made from one unitary sheet and bottom portion 112 and side portion 114 can be different portions of the same sheet. Otherwise, bottom portion 112 and side portion 114 may be joined together to form base 110. Side wall 120 can be joined to base 110 at side portion 114 through many methods of joining known to those of ordinary skill in the art. When expanding pool 100 to meet the confines of predetermined volume 200, base 100 can be laid out on the base of predetermined volume 200. In such an example, bottom portion 112 can be placed along the base of predetermined volume 200 and the remainder of pool 100 can be expanded to meet the confined of predetermined volume 200. Thus, bottom portion 112 and side portion 114 can be expanded to predetermined volume 200 to define the interior volume of pool 100.

Figure 7:
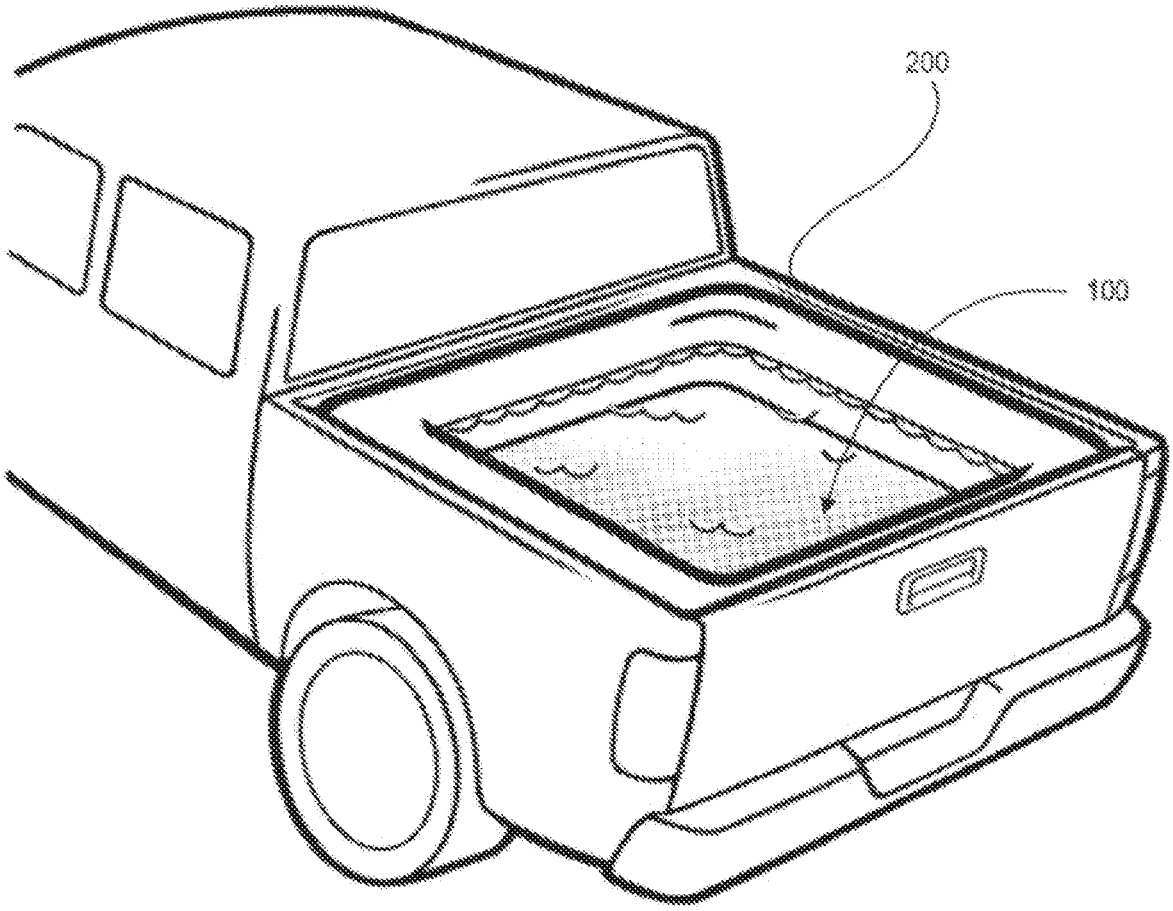
FIG. 7 is a perspective view of a pool in a predetermined volume according to some examples of the present disclosure.

FIG. 7 illustrates a pool of the present disclosure. As shown, pool 100 can be used in a deployed state such that pool 100 substantially fills and is defined by predetermined volume 200. As shown, the interior volume of pool 100 is substantially defined by the same predetermined volume 200 and is supported by predetermined volume 200. For example, as shown in FIG. 7, a pickup truck cargo bed can be provided in a substantially rectangular shape. Pool 100 may be inserted into the pickup truck cargo bed and may take the shape of the pickup truck cargo bed. It is understood that other predetermined volumes 200 may be used, such as gazebos, recesses, rooms, and the like. Any predetermined volume 200 may be selected to fit pool 100 such that predetermined volume 200 can define the interior volume of pool 100, and the walls or edges of predetermined volume 290 can provide support to the side wall of pool 100.

Figure 8A:
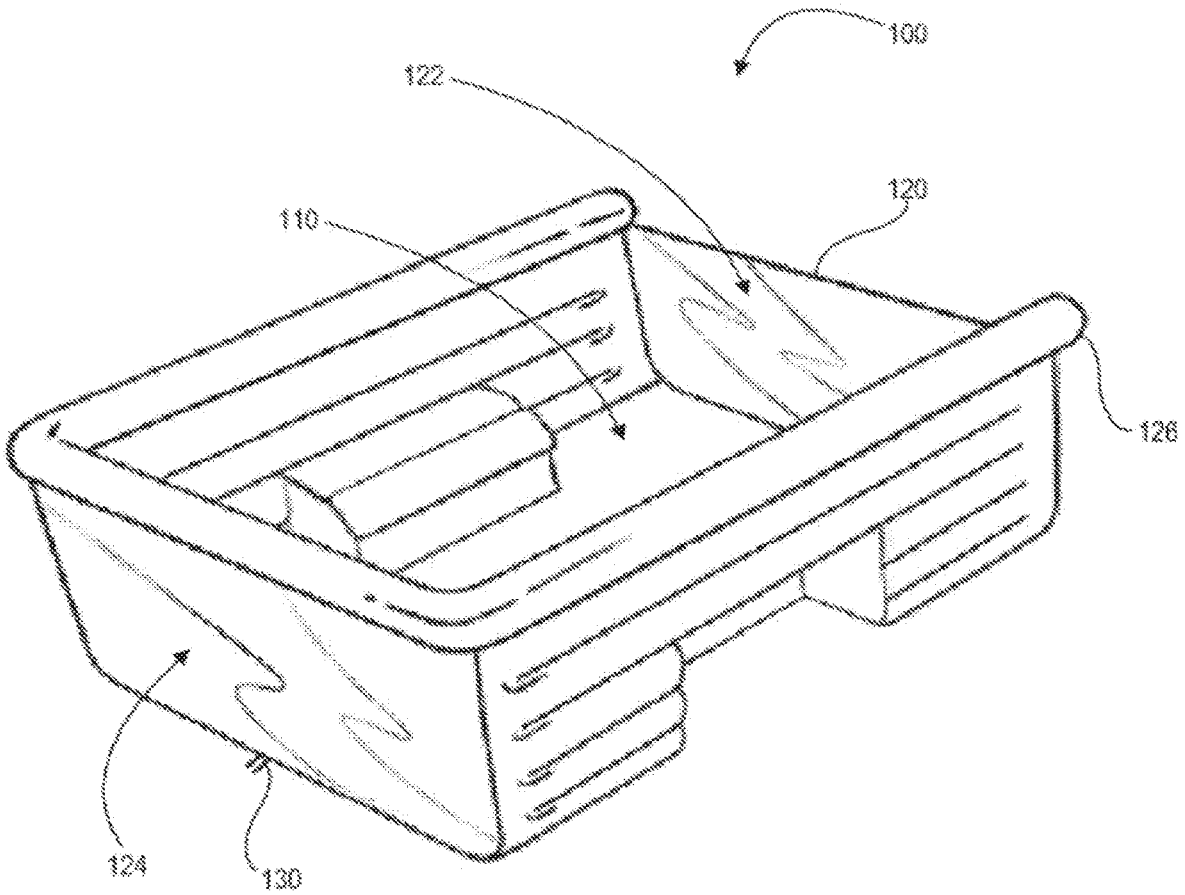
FIG. 8A is a perspective view of another pool according to some examples of the present disclosure.
Figure 8B:
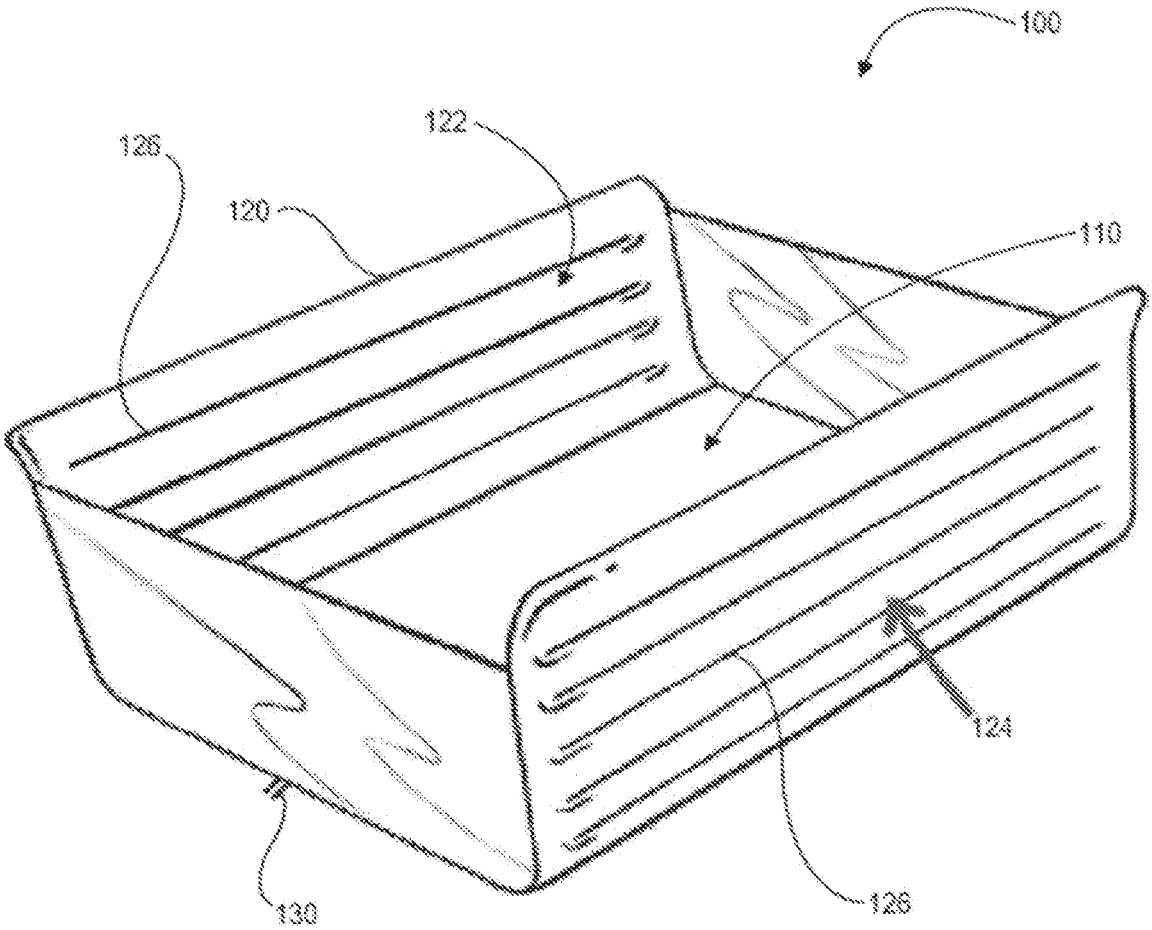
FIG. 8B is a perspective view of another pool according to some examples of the present disclosure.
Figure 8C:
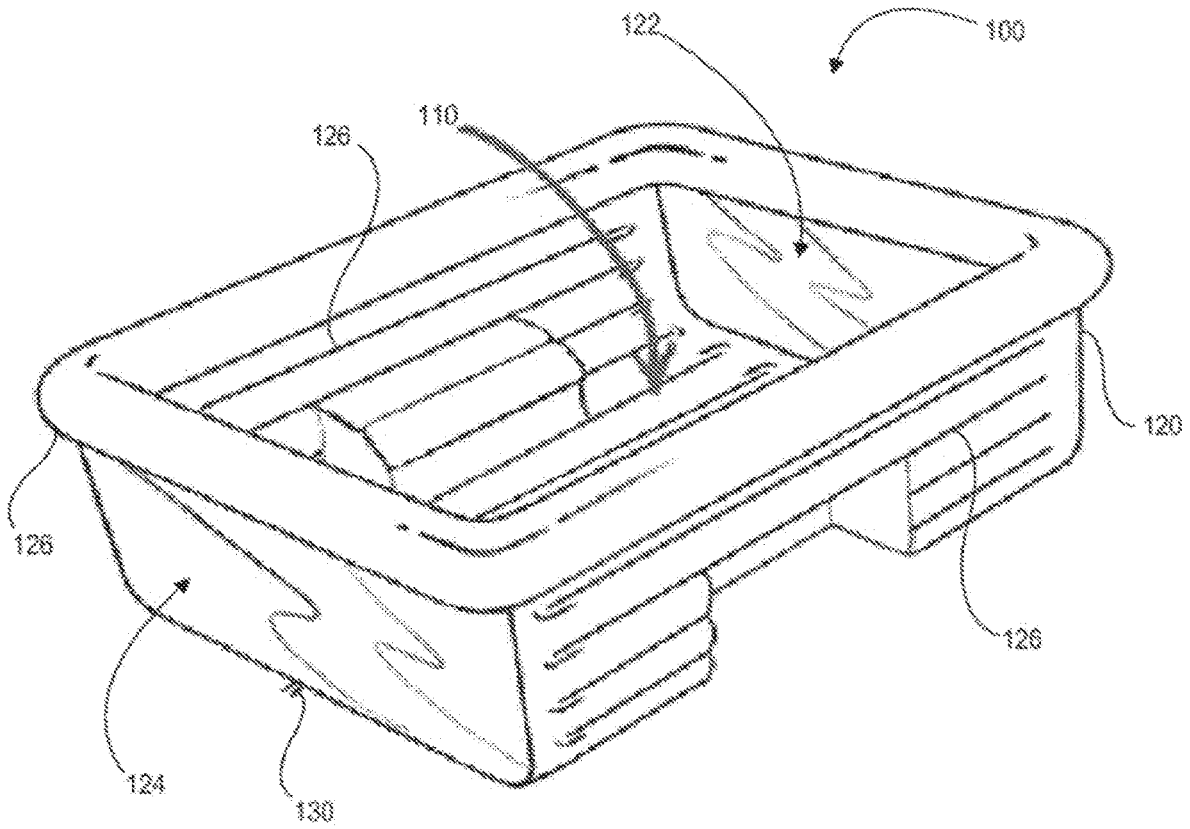
FIG. 8C is a perspective view of another pool according to some examples of the present disclosure.

As shown in FIGS. 8A-C, pool 100 can comprise base 110 and side wall 120. Side wall 120 can compose inner wall 122 and outer wall 124. Side wall 120 can further comprise one or more inflatable air chambers (shown as inflatable air chamber 126 in FIG. 8A). The inflatable air chamber may be substantially continuous around side wall 120 and thus the perimeter of the interior volume of pool 100. In other examples, as in FIG. 8B, the one or more inflatable air chambers 126 can be separated into sections of side wall 120. In some examples, as shown in FIG. 8C, side wall 120 can comprise multiple inflatable air chambers 126. The multiple inflatable air chambers 126 may be substantially continuous around side wall 120, may be separated into sections within side wall 120, or a combination thereof.

Figure 9:
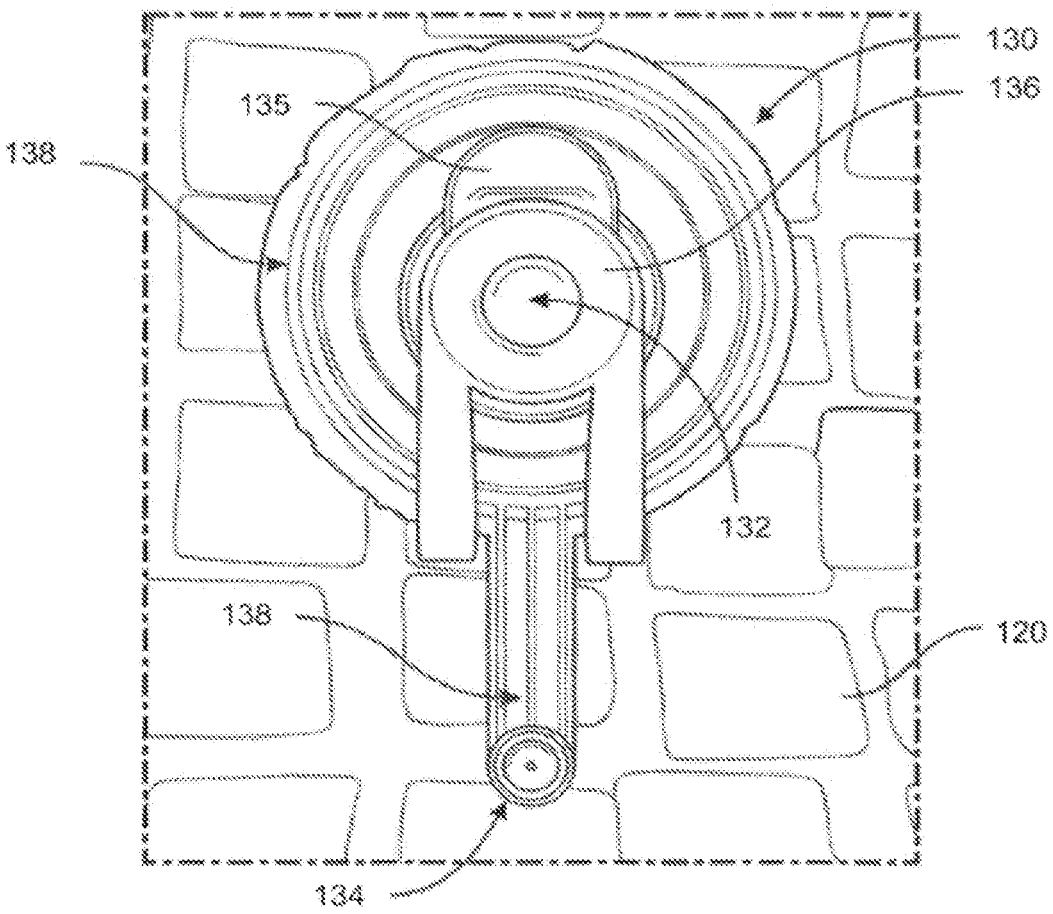
FIG. 9 is a side view of a drain for a pool according to some examples of the present disclosure.

Additionally, as shown in FIG. 9, the pool 100 can further comprise drain 130. Drain 130 can be disposed on side wall 120, base 110, or a combination thereof. In some examples, drain 130 can be disposed on a side portion of base 110 or a bottom portion of base 110. As shown in FIG. 10B, drain 130 can be disposed on base 110, but a side portion of base 110 may be raised to avoid attaching drain 130 on a joint between base 110 and side wall 120. The drain 130 can be fitted around a drain aperture cut into side wall 120 or base 110 of pool 100. In some examples, drain 130 can comprise a drain hole 132, a drain plug member 136, and a locking member 134. The drain 130 can be attached to the side wall 120 through one or more welds 138.

In some examples, the locking member 134 can be radially disposed to the drain hole 132 and can also be fastened to side wall 120. In some examples, the locking member 134 and the drain hole 132 can be connected through a member, or multiple members, comprising the same plastic material as the locking member 134 and the drain hole 132. In some examples, the locking member 134 can be separate from the drain hole 132 and fastened to the side wall 129 on its own.

The locking member 134 can be configured in such a shape to receive the drain plug member 136. In some examples, the locking member 134 can comprise a circular prong configured to adjoin a circular indentation in the drain plug member 136 through an interference fit. It is understood that other methods of affixing the drain plug member 136 to the locking member 134 are contemplated, including but not limited to, press fit, friction fit, screw threading, and others known to one of ordinary skill in the art. The drain plug member 136 can be configured to detachably attach to the locking member 134 in an open position. As would be appreciated by one of ordinary skill in the art, such an example would retain the drain plug member 136 in the open position and leave the drain hole 132 substantially unobstructed. The open position therefore can provide unproved drainage capabilities of the pool 100 and improved user experience when draining pool 100 before storage. The drain plug member 136 can also have a flap 135 to improve grip to aid a user in transitioning the drain plug member 136 between the open state and the closed slate.

In some examples, the drain plug member can be circular to match a circular drain hole. The drain plug member can comprise a radial channel around the circumference of the drain plug member configured to fit over the drain hole ridge in an interference fit. As would be appreciated by one of ordinary skill in the art, such an example would provide an increased seal during use due to the hydrostatic pressure of pool 100 pushing on the drain plug member to increase the interference fit. The drain plug member can further comprise a flap made from excess material to provide for easier gripping on the drain plug member. The drain plug member can be configured to detachably attach to the drain hole to place drain 130 in a closed position. Using the flap, a user of pool 100 can easily detach the drain plug member from the drain hole and transition drain 130 to an open position.

Figure 10A:
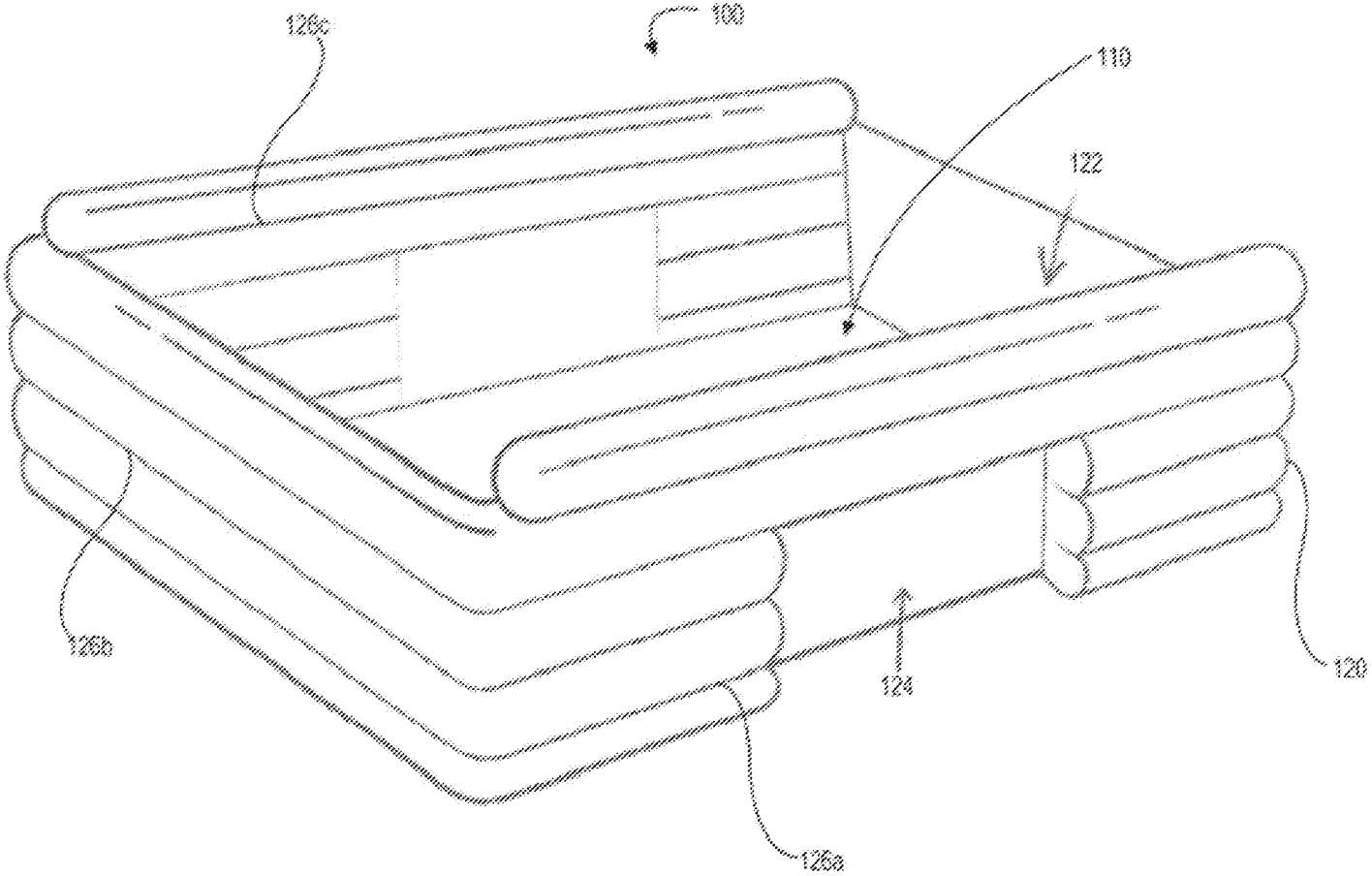
FIG. 10A is a perspective view of another pool according to some examples of the present disclosure.
Figure 10B:
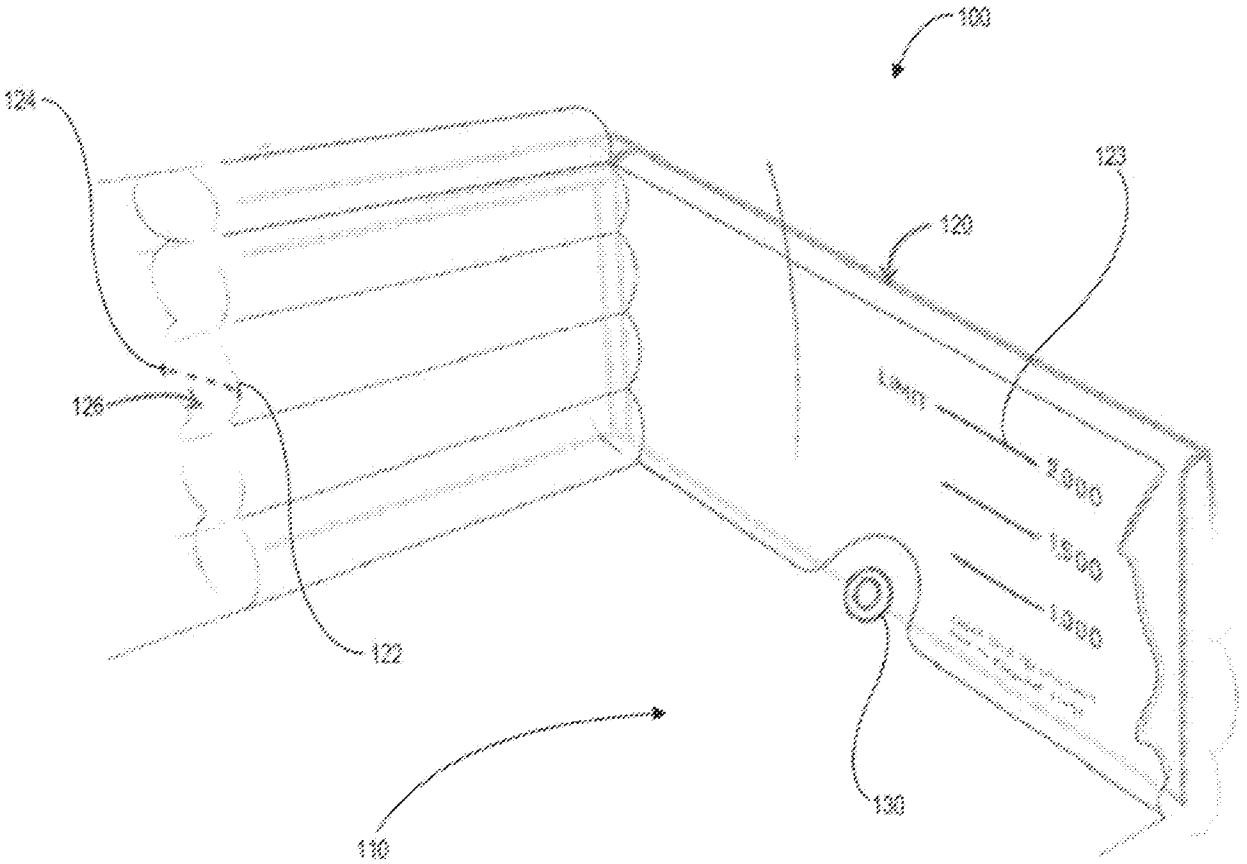
FIG. 10B is a cross-sectional view illustrating the interior volume of a pool according to some examples of the present disclosure.

FIG. 10A illustrates a pool 100 comprising base 110 and side wall 120. As shown, in some examples, pool 100 may comprise no drain. Side wall 120 can further comprise inner wall 122, outer wall 124, and one or more inflatable air chambers 126 (shown by inflatable air chambers 126*a-c*). The one or more inflatable air chambers 126 may be substantially continuous around side wall 120 (i.e., inflatable air chamber 126*c*), may be separated into sections within side wall 120 (i.e., inflatable air chambers 126*a* and 126*b*), or a combination thereof. As shown, inflatable air chambers 126 can be aligned substantially vertically in the side wall 120 (i.e., inflatable air chamber 126*c* is vertically on top of inflatable air chamber 126*b* is vertically on top of inflatable air chamber 126*a*). As would be appreciated by one of skill in the art, such an example would provide padding for side walls 120, improve the transition of pool 100 to the deployed state, and increase the structural stability of pool 100 by aligning the inflatable air chambers 126.

FIG. 10B illustrates the interior volume of a pool 100. As shown, pool 100 can comprise base 110, side wall 120, and drain 130. As shown, side wall 120 can further comprise inner wall 122 and outer wall 124. Side wall 120 can further comprise one or more inflatable air chambers 126, and the one or more inflatable air chambers 126 can be defined by a void or a volume between inner wall 122 and outer wall 124. Additionally, inner wall 122 can comprise indicia 123. Indicia 123, for example, can label portions of pool 100, provide water level indicators or other safety features for pool 100, such as weight or volume limits, or provide aesthetic designs or patterns for inner wall 122. Indicia 123 can also comprise features such as safety warnings, instructions, brand labels, manufacturer labels, and the like. The indicia 123 can also include water level markers translating a volume of water in the pool 100 to overall weight of the pool. As would be appreciated, such water level markers can prevent a user from overfilling the pool 100. For example, a user can keep the water level below a certain level in order to not exceed the payload capacity of their truck bed. It is understood that while indicia 123 is displayed on inner wall 122 in FIG. 10B, indicia 123 may be on any surface of pool 100 desired by the manufacturer. For example, indicia 123 may be placed on base 110 or outer wall 124.

Figure 11:
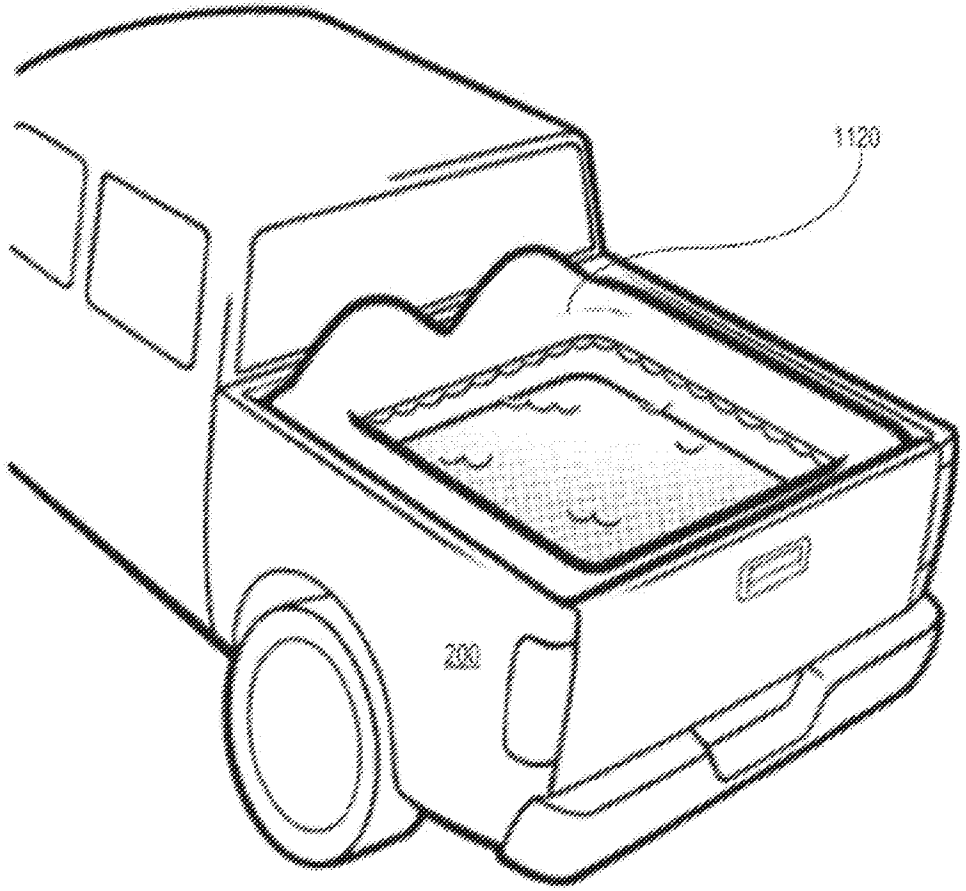
FIG. 11 is a perspective view of a pool with headrests in a predetermined volume according to some examples of the present disclosure.

Furthermore, as shown in FIG. 11, the pool 100 can also have headrests 1120 attached to the top of the side wall 120. The headrests 1120 can create a buffer zone between the users and the predetermined volume 200, such as a metal truck bed the headrests 1120 can insulate the user from hot or sharp surfaces while offering soft support. For instance, a truck bed can be a metal and rigid structure with sharp edges that are not comfortable to rest against. The metal can also become very hot under the sun and cause irritation. The headrests 1120 can protect the user from the truck bed and increase the comfort in the pool. Additionally, certain areas or points on the pool 100 can be reinforced with thicker gauge material to protect against hooks or any other sharp edges inside a truck bed, such as the side wall 120. Other sharp areas can be found on the metal edges on the folds of the truck bed walls, and such areas can be reinforced with additional plastic material.

An embodiment of the present disclosure can be implemented according to at least the following:

Clause 1: A fluid container, comprising: a base, having a bottom portion and a side portion; and a side wall joined to the base at the side portion and defining an interior volume of the fluid container, the side wall comprising an inner wall; an outer wall, a first and a second inflatable air chamber each defined by n volume between the inner wall and the outer wall; and at least one air valve disposed on the outer wall and in fluid communication with the at least one inflatable air chamber.

Clause 2: The fluid container of Clause 1, wherein the bottom portion and the side portion are one unitary sheet.

Clause 3: The fluid container of Clause 1, wherein the first inflatable air chamber is joined to the base at the side portion, and the second inflatable air chamber is joined to the first inflatable air chamber.

Clause 4: The fluid container of Clause 3, wherein the first and the second inflatable air chambers are aligned in the side wall substantially vertically.

Clause 5: The fluid container of Clause 1, wherein the first and second inflatable air chambers are substantially continuous around the side wall.

Clause 6: The fluid container of Clause 1, wherein the at least one air valve comprises a first air valve disposed on the outer wall and in fluid communication with the first inflatable air chamber, and a second air valve disposed on the outer wall and in fluid communication with the second inflatable air chamber.

Clause 7: The fluid container of Clause 1, the base and the side wall are made from a flexible plastic material.

Clause 8: The fluid container of Clause 1, further comprising a drain comprising: a drain hole; a locking member disposed radially with respect to the drain hole; and a drain plug member configured to: attach to the drain hole in a closed state, and attach to the locking member in an open state.

Clause 9: A pool for a predefined volume the pool comprising: a base, having a bottom portion and a side portion; and a side wall joined to the base at the side portion, the side wall having an inner wall and an miter wall, the inner wall defining an interior volume and the outer wall defining an area substantially similar to the predefined volume, the side wall comprising a drain; and at least one upward force providing member configured to retain the side wall in an erect position.

Clause 10: The pool of Claim 9, wherein the at least one upward force providing member comprises an inflatable air chamber defined by a volume between the inner wall and the outer wall.

Clause 11: The pool of Clause 10, wherein the inflatable air chamber comprises a first inflatable air chamber joined to the base at the side portion, and a second inflatable air chamber joined to the first inflatable air chamber.

Clause 12: The pool of Clause 11, wherein the first and the second inflatable air chambers are aligned in the side wall substantially vertically.

Clause 13: The pool of Clause 10, wherein the inflatable air chamber is substantially continuous around the side wall.

Clause 14: The pool of Clause 11, wherein the side wall further comprises a first air valve disposed on the outer wall and in fluid communication with the first inflatable air chamber, and a second air valve disposed on the outer wall and in fluid communication with the second inflatable air chamber.

Clause 15: The pool of Clause 9, wherein the bottom portion and the side portion are one unitary sheet.

Clause 16: The pool of Clause 9, wherein the base and the side wall are made from a flexible plastic material.

Clause 17: The pool of Clause 9, wherein the drain comprises: a drain hole: a locking member disposed radially with respect to the drain hole; and a drain plug member configured to: attach to the drain hole in a closed state, and attach to the locking member in an open state.

Clause 18: A method of forming a pool in a predefined volume, the method comprising: providing a predefined volume: placing a pool along a base of the predefined volume, wherein the pool comprises: a base, having a bottom portion and a side portion: and a side wall joined to the base at one side portion, the side wall comprising: a first plastic material: an inner wall, an outer wall, at least one inflatable air chamber defined by a volume between the inner wall and the outer wall, and at least one air valve disposed on the outer wall and in fluid communication with the at least one inflatable air chamber; wherein the bottom portion is placed along the base of the predefined volume, inflating the at least one inflatable air chamber using the at least one air valve: stretching the base of the pool such that the side portion is substantially contacted with the predefined volume, and filling the pool with water such that the at least one inflatable air chamber causes the side wall of the pool to transition to an erect position, wherein the side wall is substantially contacted with the predefined volume.

Clause 19: The method of Clause 18, wherein the at least one inflatable air chamber comprises a first inflatable air chamber joined to the base at the side portion, and a second inflatable air chamber joined to the first inflatable air chamber.

Clause 20: The method of Clause 19, wherein the first and the second inflatable air chambers are aligned in the side wall substantially vertically.

Clause 21: The method of Clause 20, wherein the filling further comprises filling the pool with water such that the water is at a level between the first and the second inflatable air chambers.

Clause 22: The method of Clause 18, wherein the predefined volume is a cargo bed of a pickup truck.

While the present disclosure has been described in connection with a plurality of exemplary aspects, as illustrated in the various figures and discussed above, it is understood that other similar aspects can be used or modifications and additions can be made to the described aspects for performing the same function of the present disclosure without deviating therefrom. For example, in various aspects of the disclosure, methods and compositions were described according to aspects of the presently disclosed subject matter. However, other equivalent methods or composition to these described aspects are also contemplated by the teachings herein. Therefore, the present disclosure should not be limited to any single aspect, but rather construed in breadth and scope in accordance with the appended claims

What is claimed is:

1. A fluid container, comprising:

a base configured to fit within a predetermined volume and comprising a bottom portion configured to be supported by a bottom surface of the predetermined volume; and a side wall joined to the base and defining a portion of an interior volume of the fluid container, wherein the side wall is configured to be supported by an interior surface of the predetermined volume, the side wall comprising:

a first inflatable air chamber and a second inflatable air chamber at least partially above the first air chamber;

a first air valve disposed on a first inflatable air chamber outer wall and in fluid communication with the first inflatable air chamber; and a sheet below the first inflatable air chamber, wherein the side wall includes a recess to accommodate a portion of the interior surface of the predetermined volume.

2. The fluid container of claim 1, wherein the first inflatable air chamber is joined to the base, and the second inflatable air chamber is joined to the first inflatable air chamber.

3. The fluid container of claim 2, wherein the first inflatable air chamber and the second inflatable air chamber are aligned in the side wall substantially vertically.

4. The fluid container of claim 1, wherein the first inflatable air chamber and second inflatable air chamber are substantially continuous around the side wall.

5. The fluid container of claim 1, further comprising a drain, the drain comprising:

a drain hole;

a locking member disposed radially with respect to the drain hole; and a drain plug member configured to:

attach to the drain hole in a closed state, and attach to the locking member in an open state.

6. The fluid container of claim 5, wherein the drain is disposed on a portion of the fluid container substantially adjacent to a door of the predetermined volume.

7. The fluid container of claim 1, wherein the first air valve is disposed on a first surface of the first inflatable air chamber and is substantially adjacent to a door of the predetermined volume.

8. The fluid container of claim 7, the side wall further comprising a second air valve disposed on a second inflatable air chamber outer wall and in fluid communication with the second inflatable air chamber, wherein the second air valve is disposed on a second surface of the second inflatable air chamber and is substantially adjacent to a door of the predetermined volume.

9. A fluid container, comprising:

a sheet comprising a base and a side portion, the base comprising a bottom portion defined by a bottom of a predetermined volume and wherein the side portion is joined to the bottom portion, wherein the side portion is defined by an interior surface of the predetermined volume;

a first air chamber above the side portion and joined to the side portion, and a second air chamber at least partially above the first air chamber;

wherein the sheet and the first air chamber comprise an interior volume configured to contain a fluid, and wherein the side portion includes a recess to accommodate a portion of the interior surface of the predetermined volume.

10. The fluid container of claim 9, wherein the first air chamber is configured to be partially supported on the fluid within the interior volume.

11. The fluid container of claim 9, wherein the base comprises a seat.

12. A fluid container, comprising:

a base comprising a bottom portion defined by a base of a bottom of a predetermined volume, a side portion defined by a side of the predetermined volume, a first end wall defined by an inner side of the predetermined volume, a second end wall defined by an outer side of the predetermined volume;

a first air chamber joined to the base and disposed between the first end wall and the second end wall; and a second air chamber at least partially above the first air chamber, wherein the second air chamber is joined to the first air chamber, and wherein the second air chamber is disposed between the first end wall and the second end wall;

wherein the side portion includes a recess to accommodate a portion of the side of the predetermined volume.

13. The fluid container of claim 12, further comprising a first air valve, and wherein the first air valve is in fluid communication with the first air chamber and is substantially adjacent to a door of the predetermined volume.

14. The fluid container of claim 12, further comprising a drain, and wherein the drain is disposed in the fluid container substantially adjacent to a door of the predetermined volume.

15. The fluid container of claim 14, wherein the drain comprises:

a drain hole;

a locking member disposed radially with respect to the drain hole; and a drain plug member configured to:

attach to the drain hole in a closed state, and attach to the locking member in an open state.

16. The fluid container of claim 12, further comprising a headrest attachable to the second air chamber.

17. The fluid container of claim 12, wherein the base is extendable to reach at least one dimension of a predetermined volume.

18. The fluid container of claim 12, wherein the predetermined volume comprises an enclosure or semi-enclosure.

19. A method of filling a fluid container, comprising:

deploying a base at least partially within a predetermined volume, wherein the base comprises a base portion and a side wall, wherein the base portion is joined to the side wall, wherein the side wall comprises a sheet and at least one inflatable air chamber above the sheet, a second air chamber at least partially above the at least one inflatable air chamber, and wherein the side wall includes an indicia configured to indicate a fluid level;

inflating the at least one air chamber;

filling a fluid into a volume defined by the base portion and the side wall; and indicating via an indicia if a threshold fluid capacity is reached or exceeded;

wherein the side wall includes a recess to accommodate a portion of an interior surface of the predetermined volume.

* * * * *